United States Patent [19]

Werner et al.

[11] 4,334,834

[45] Jun. 15, 1982

[54] SUBMERSIBLE PUMP STABILIZER

[76] Inventors: Werner R. Werner; Bruno R. Werner, both of 309 Schoolhouse Rd., Old Saybrook, Conn. 06475

[21] Appl. No.: 79,790

[22] Filed: Sep. 28, 1979

[51] Int. Cl.[3] ..... F04B 35/04; F04B 17/00

[52] U.S. Cl. ..... 417/360; 417/424

[58] Field of Search ..... 166/105, 107; 417/360, 417/424; 248/676

[56] References Cited

U.S. PATENT DOCUMENTS

| | | | |
|---|---|---|---|
| 1,437,939 | 12/1922 | Green | 166/105 |
| 2,853,950 | 9/1958 | Lovell | 417/424 |
| 3,521,970 | 7/1970 | Deters | 417/424 |
| 3,721,504 | 3/1973 | Crisafulli | 417/424 |
| 3,779,670 | 12/1973 | Crisafulli | 417/231 |
| 4,190,113 | 2/1980 | Harrison | 166/107 |

*Primary Examiner*—William L. Freeh
*Attorney, Agent, or Firm*—C. G. Nessler

[57] ABSTRACT

A stabilizer for a submersible pump in a well bore is attached to the pump so that it extends from the lower end of the pump toward the bottom of the well. When placed in the well, the stabilizer engages sandy debris in the well and thereby positions the pump vertically, while at the same time providing resistance to lateral and torsional forces caused by on-off cycling of the pump. One embodiment of the stabilizer further has expansible means which are actuated by contact of the device with the well bottom; the expansible part provides additional lateral and torsional support when the pump is in place, but conveniently retracts for easy removal of the pump as it is lifted.

1 Claim, 5 Drawing Figures

SUBMERSIBLE PUMP STABILIZER

BACKGROUND OF THE INVENTION

The invention relates to pumps and other apparatus in wells, and more particularly to vertical positioners and torque arrestors for submersible water pumps.

Submersible centrifugal pumps powered by electric motors are commonly suspended at the end of the length of a pipe within a well. A problem common to small diameter wells in many locations is that particulate debris is present on the bottom of the well, either from its original use or with the passage of time. It is therefore necessary that a submersible pump be located some distance above debris, to avoid entrainment of it into the pump intake with consequent damage of the impellers. Normally, this is accomplished by first measuring the depth of the well and then providing only sufficient pipe to suspend the pump the desired distance above the debris. However, if the debris is particularly light it is difficult to ascertain its depth at the bottom of the well. On the other hand it is undesirable to suspend a pump too great a distance above any debris since it is advantageous to be able to "draw down" the maximum water in the well when demand exceeds the infiltration capacity of the well.

Another problem in applications such as domestic water supplies results from periodic on-off pump cycling. When the pump motor is started there is a force between the armature and field, with the result that a torsional moment is imparted to the pump housing. The pump is characteristically fitted rather closely in the well; e.g. a four inch diameter pump may be in a six inch well bore. Thus, there is a tendency for the suspended pump to both rotate and move laterally, twisting the suspending pipe and causing contact with the well bore. This effect is especially present when pumps are suspended in a well from long thermoplastic pipes.

The lateral movement and contact of the pump with the well bore can cause abrasion and eventual failure of the pump housing. Repetitive torsion may cause pipe failure and loosening of associated pipe fittings. Therefore, means to prevent such damage are required. A conventional device presently used is comprised of a collar or multiplicity of fingers extending from the pump or the pipe line near the pump. The device, often made of a resilient material such as a thermoplastic or rubber, is adjusted to the nominal diameter of the well prior to lowering of the pump into the well. Thus, the device has a tendency to rub along the sides of the well bore, thereby impeding the lowering or raising of the pump. Further, the device must be adjusted to pass by the narrowest point in the well, and if the well bore varies in diameter the device may not fully prevent movement when the pump is at its working location in the well. Still another problem results when a conventional torque arrestor is fitted to the pipe just above the pump; in many pumps the direction of rotation is such that there is a tendency for loosening of the fitting which adapts the pipe to the pump discharge.

Accordingly, there is a need for an improved means for positively locating and fixing the position of a submersible pump within a well bore, both laterally and vertically.

SUMMARY OF THE INVENTION

According to the invention, a stabilizer for a submersible pump is attached to the bottom of the pump and engages the material at the bottom of the well, thereby resisting vertical, rotational, and lateral motion of the pump. The stabilizer is of sufficient length to support the pump above debris in the well. In a preferred embodiment, the lower end of the stabilizer has an irregular cross section to increase resistance to rotational motion; and the upper end is adapted to receive and capture the bottom end of the pump, yet allow circulation of water thereabout.

In another preferred embodiment, the stabilizer is comprised of two parts and an expansible device. The upper part is attached to the pump and the lower part is attached in axially movable fashion to the upper part; the expansible device is connected between the upper and lower parts. When the lower part contacts the well bottom, the lower part's relative movement toward the upper part actuates the expansible device, thereby causing it to contact the well bore and provide lateral and rotational stability. Vertical stability is provided by the interaction of the upper and lower parts of the stabilizer.

The invention provides a simple yet effective means for both positively positioning a pump vertically and for resisting damaging torsional forces. The invention may be readily constructed out of thermoplastics or metals in economic fashion. Further, the apparatus permits easy raising and lowering of the pump since its diameter is insubstantially larger than that of the pump body during such operations. A further advantage of the invention is that it is possible in special circumstances to use piping which is of lighter weight than heretofore, since the axial weight and torsional forces are both counteracted by the invention.

Other aspects and features of the invention will be evident from the Figures and Description of the Preferred Embodiment which follows.

DESCRIPTION OF THE PREFERRED EMBODIMENT

The invention herein is described in terms of a submersible electric motor pump placed in a water well drilled in rock, although it may be used in other types of wells, and for other devices and structures wherein a similar problem is solved.

A well bore in which the invention is particularly usable is usually drilled in rock or otherwise has a rigid wall. Typically, there will be drilling debris remaining in the well; usually this is gravel and light sand. Over time, further quantities of sand and like material may infiltrate and accumulate at the bottom of the well. If entrained into the pump, damage can be caused, and therefore it is an object to hold the pump a sufficient distance above the bottom of the well to avoid this. In this disclosure, reference is often made to the well bottom. By this is meant any material in the well at its terminus which is capable of supporting the apparatus of the invention. Most commonly, this will comprise the coarser sand, gravel, and stone materials residing at the bottom of the well, having a consistency which allows partial penetration of the stabilizer.

Figure 1:
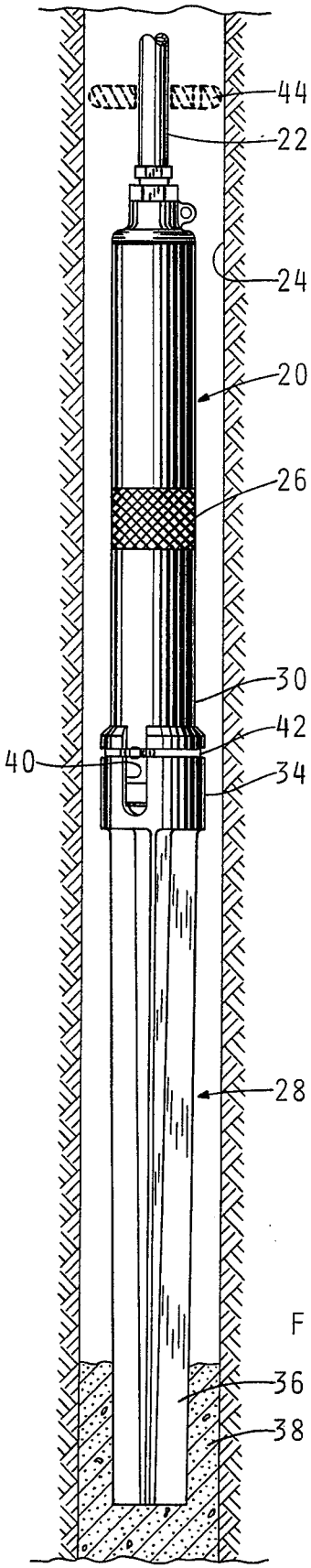
FIG. 1: shows a pump suspended in a well bore with an attached stabilizer in engagement with the well bottom.
Figure 2:
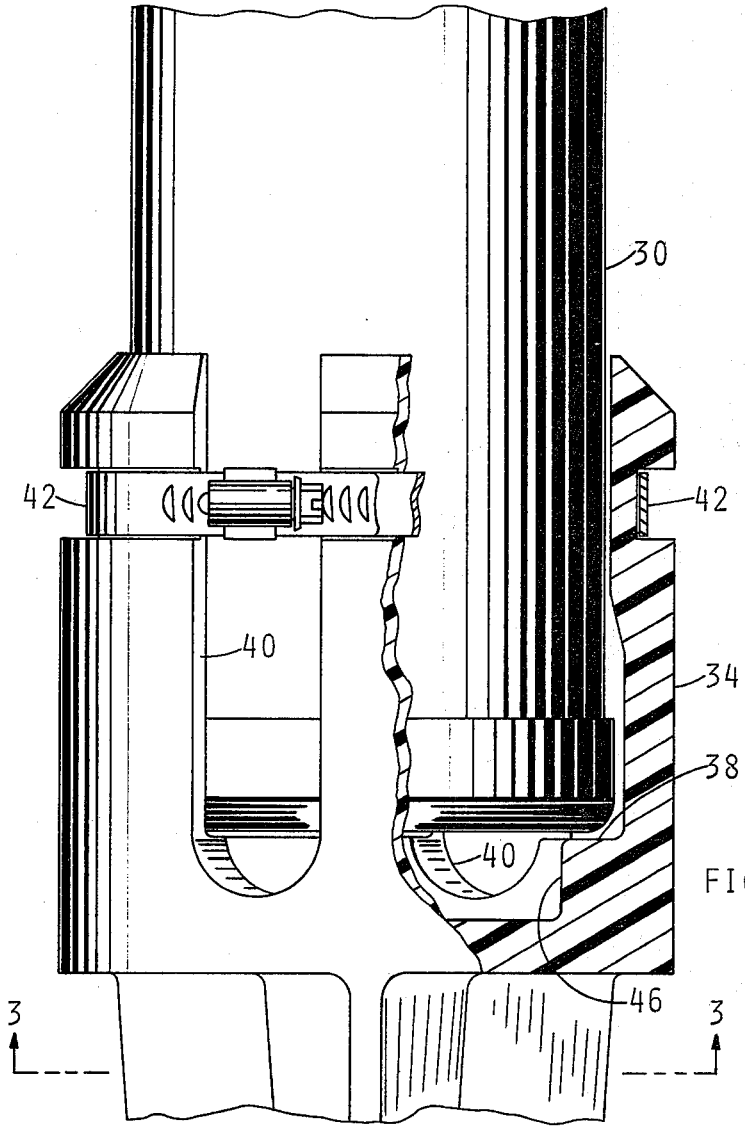
FIG. 2: shows a partial section of the attachment of the stabilizer to the pump body.
Figure 3:
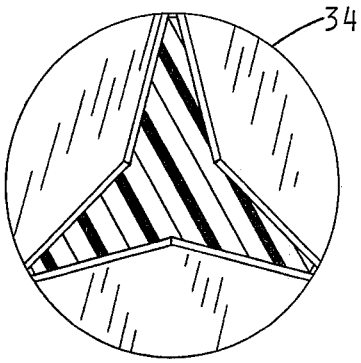
FIG. 3: shows a cross section of the lower end of the stabilizer along line 3—3 of FIG. 2.

The FIGS. 1–3 show a preferred embodiment of the invention and illustrate its general mode of operation. FIG. 1 shows a pump 20 suspended in a water well bore 24 by a pipe 22. The pump has a water inlet 26 at its mid point. A stabilizer 28 of the present invention is attached to the lower end 30 of the pump. The stabilizer is comprised of a rigid structure 28 fixed at its first end 34 to the lower end 30 of the pump in a manner which resists axial, lateral, and rotational motion. The second end 36 of the stabilizer is adapted to engage the bottom 38 of the well bore.

The attachment of the stabilizer to the pump is shown in more detail in FIG. 2. It may be seen that the first end 34 of the stabilizer is a hollow cylinder with one or more axial slots 40. Thus the pump body may be received within the hollow cylindrical end and a clamp 42 provides compressive force to the cylinder. Of course the cylinder is made of a material with properties which enable it to be deflected by action of the clamp and thereby capture the pump body. Tightening of the clamp causes frictional engagement with the pump sufficient for most purposes. But, a shoulder 38 is best further provided to engage the base of the pump, thereby ensuring that the cylinder will not progressively move along the pump under axial force. Keyways, pins, or the like may also be added to ensure the absence of relative axial and rotational motion. The outer diameter of the first end 34 is to be minimized so as to be less than the diameter of the well bore.

The second end 36 of the stabilizer engages the bottom 38 of the well, penetrating through lighter material until friction prevents further motion, or until heavier material is encountered. The stabilizer has an axial length sufficient to hold the pump vertically above the entrainable debris which is present or may accumulate over time. This length is determinable by experience in a particular area of the country, and typically will be 2 to 3 meters. The second end 36 of the stabilizer is preferably shaped to frictionally engage the loose material, as by increasing the surface area, to resist torsional and lateral movement.

As shown in the Figures, including FIG. 3, the lower end of the stabilizer preferably has an irregular and serrated cross section, such as the three-pointed star shape shown, to better engage the bottom of the well in a manner which will resist torsional motion. Other shapes may be used as well and in certain instances it will be found to be satisfactory to merely have a continuation of the simple hollow cylindrical shape of the first end with or without serrations such as comprise an internal or external spline. Also the second end may be of other irregular shapes, such as that of a flat panel or other like mechanical configuration which provides both a rotationally and axially stable engagement. But, while the exact configuration is optional, it is desired that the second end have a certain minimum cross sectional profile, especially if the material at the bottom is very fine and of low bearing strength. An embodiment of the second end especially suited for such material is comprised of an end furthest from the pump which has a low cross section and high area, then transitioning nearer the pump to a higher cross section; that is, a more abrupt section change than the taper shown in FIGS. 1–3. Accordingly, the stabilizer will first penetrate easily and then with great resistance, ensuring some penetration for resisting rotation, but avoiding overly great penetration to provide vertical locating.

In use, the stabilizer is fixed to the pump prior to the lowering of the pump into the well. As the pump is lowered toward the bottom of the well, the stabilizer will contact and penetrate the bottom until the weight of the pump (and a portion of the suspending pipe as well) is supported by the resistance of the bottom to further penetration. Thus the vertical location will be fixed and tensile stress on the pipe will be reduced. When the pump is activated, the reaction force of the motor starting forces will seek to move the pump both rotationally and laterally. But this motion will be resisted by the affixed stabilizer due to its engagement with the bottom.

There are some other aspects of the preferred embodiment of the stabilizer which deserve note. The stabilizer may of course be used in cooperation with other types of devices previously known. For example, as shown in FIG. 1, a lateral support 44 affixed to the upper end of the pump, or pipe adjacent thereto, may be added to further resist lateral motion. Also, it is preferred that water be allowed to circulate about the lower end 30 of the pump where the stabilizer is attached for proper cooling of this section of the pump body. Thus a cavity 46 is desirably provided at the first stabilizer end, with ingress and egress of water provided by axially extending slots 40 along the first end of the stabilizer which intercept the cavity. Of course other means may be readily used to attach the stabilizer to the pump, other than the slotted hollow cylinder shown. For example, a female socket may be permanently attached to the bottom of the pump, and a male mating portion of the stabilizer engaged with it, with threads, set screws, and the like. Further, the portion of the stabilizer structure connecting the upper and lower ends which is not intended to penetrate the bottom may be of arbitrary design, so long as it is sufficiently rigid to perform its function. And of course, to allow easy shipment the stabilizer may be comprised of two or more joinable pieces.

Figure 4:
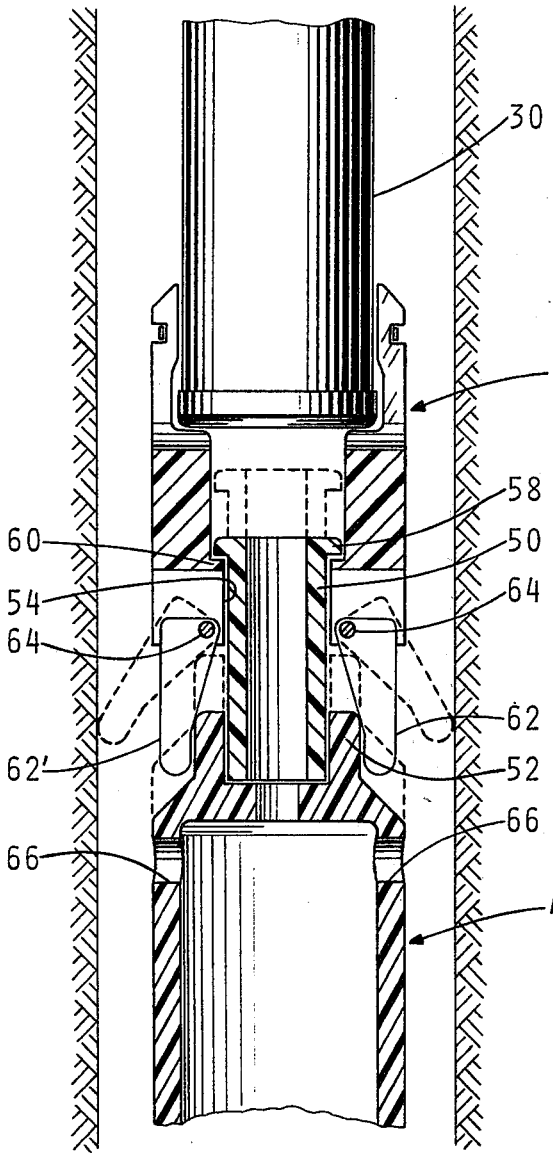
FIG. 4: shows a cross section along line 4—4 of FIG. 5.
Figure 5:
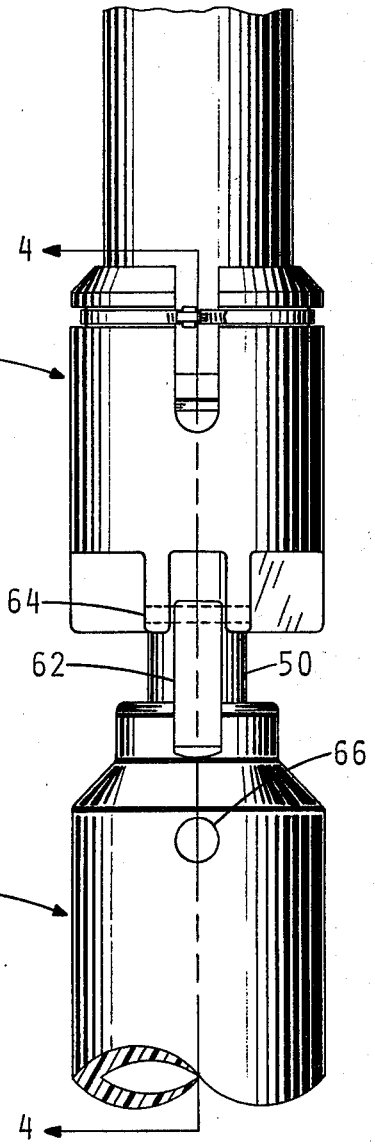
FIG. 5: shows an alternate embodiment of a stabilizer having movable parts and expansible arms for contacting the well bore.

A further embodiment of the invention which provides increased lateral and torsional stability is shown in FIGS. 4 and 5. The stabilizer is now broken into two parts, 47 and 48, which can move axially with respect to one another. Expansible means for contacting the well bore are interposed between the parts and are actuated by relative motion of the parts. Referring to the Figures, the upper part 47 essentially has the configuration of the previously described first end 34 insofar as engagement with the pump is concerned. The lower part 48 has a lower end (not shown) which in configuration and function is like the second end 36 of the previous embodiment. The two parts are interconnected by a bushing 50 which is permanently fixed to the lower part 48 at its upper end 52 and which is slidably movable within a bore 54 in the upper part 47. The bushing has a head 58 to retain it within the bore 54 by engagement with the shoulder 60. Between the upper and lower parts are positioned two arms 62 and 62', pivoted from the upper part by pins 64. The arms are positioned so that they may be caused to pivot by the lower part's relative movement toward the upper part. Thus, it may be seen that essentially the upper part simply provides a means for positioning the lower part in a manner which enables it to movably actuate the expansible device comprised of the two arms.

As shown in the Figures, the arms are in their unactuated position when the upper and lower parts of the stabilizer are at their maximum separation. This is the configuration of the stabilizer as the pump is lowered into the well, and it is seen that the stabilizer has no greater diameter than that provided by the part which encompasses the pump body. As the pump is lowered, the bottom end of the stabilizer's lower part 48 will ultimately contact the bottom of the well and thereby cause the upper and lower parts to move relatively closer. The upper end 52 of the lower part 48 thereupon contacts arms 62–62' and causes them to pivot outwardly until they contact the well bore, as shown in phantom, the length of the arms having been selected to suit the well bore. Some further vertical motion may ensue as the arms slide vertically along the wall while the lower part of the stabilizer settles firmly at the bottom of the well. Thus the weight of the pump and pipe will actuate the expansion of the arms, by the relative motion of the parts and contraction of the stabilizer. The contact of the arms with the well bore provides resistance to torsional and lateral movement. As the arms contact the bore and thus can move outwardly no further, further relative motion of the lower part of the stabilizer is also stopped, and vertical support to the pump is thereby provided. Of course, a portion of the vertical load may be borne by the expansible device and suspending pipe as well, but it is desirable that the major portion of the load be borne by the stabilizer. As shown in the embodiment of FIGS. 4 and 5, there is relative rotary motion possible between the upper part and the lower part of the stabilizer. Thus the lower part of the stabilizer provides only lateral and vertical resistance. An alternate embodiment would comprise means to prevent this relative motion, such as an irregularly-shaped or keyed bushing 50 and bore 54. In such an embodiment, the resistance to torsional motion would be provided cooperatively by the expansible device and the lower part of the stabilizer.

When the pump and stabilizer are sought to be removed from the well, vertical motion is applied to the pump body, as through the suspending pipe or other conventional means. Whereupon, the reverse of the previously described motion is caused by force of gravity on the elements, and the expansible means retract, allowing free withdrawal from the well.

In the embodiment of FIGS. 4 and 5, the lower part of the stabilizer is shown as a hollow cylinder, in accord with the discussion attending the prior embodiment. One or more holes 66 are provided through the wall of the cylinder to allow venting of the cylinder when it is sought to remove the pump from the well. Thus, when the hollow cylinder is designed to be open at its bottom end where it contacts the well bottom, the release of entrapped air, water, mud, and the like will be aided. Of course, other shapes of openings may be provided. The expansible means shown in the embodiment of FIGS. 4 and 5 is comprised of two arms. A greater number of arms may be used, as well as other expansible devices, such as elastomeric cylinders or other known spring and gravity actuated devices which increase in diameter upon the application of axial force and decrease in diameter in its absence. The stabilizer may be constructed out of metals, thermoplastics, or other materials which have durability within the medium of the well. Most preferably it is economically made mostly out of a thermoplastic such as ABS plastic for a water well of the domestic type.

While our invention has been described in the foregoing preferred embodiment and alternatives, it should not be so limited, as it is capable of many modifications and changes in construction and arrangement which may be made without departing from the spirit and scope of the invention.

That which we claim and desire to secure by U.S. Letters Patent is:

1. A stabilizer for positioning a pump vertically and for resisting torsional forces in a well bore having sandy penetrable material at its bottom, comprising a rigid structure having a first end and a second end along an axis; the first end having means to receive and non-rotatably engage the body of the pump and to receive axial and lateral force therefrom; and, the second end having means for contacting and frictionally engaging the bottom of the well, to resist vertical, rotational, and lateral motion; the structure being of an axial length sufficient to support the pump above entrainable debris, characterized by a first end shaped to provide a cylindrical cavity in proximity to the body where it is engaged by the first end; passages connecting the cavity with the liquid being pumped, to allow circulation within the cavity of liquid for cooling the pump body; the structure further having a taper extending substantially along the length of the structure, the cross section of the taper increasing from the second end to the first, thereby enabling the stabilizer to first easily penetrate material at the bottom of a well bore, to provide engagement therewith for resisting rotational motion, the cross section providing increasing resistance with further penetration, thereby providing engagement for resisting vertical motion.

* * * * *